US009130285B2

(12) United States Patent
Scanzillo et al.

(10) Patent No.: US 9,130,285 B2
(45) Date of Patent: Sep. 8, 2015

(54) PUSH WIRE CONNECTOR HAVING A SPRING BIASING MEMBER

(71) Applicant: Hubbell Incorporated, Shelton, CT (US)

(72) Inventors: Thomas L. Scanzillo, Monroe, CT (US); Edward R. Bazayev, Kew Gardens, NY (US); Robert Simon, Shelton, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 2 days.

(21) Appl. No.: 14/015,360

(22) Filed: Aug. 30, 2013

(65) Prior Publication Data

US 2014/0170908 A1 Jun. 19, 2014

Related U.S. Application Data

(60) Provisional application No. 61/697,106, filed on Sep. 5, 2012.

(51) Int. Cl.

| | |
|---|---|
| ***H01R 4/48*** | (2006.01) |
| ***H01R 4/50*** | (2006.01) |
| ***H01R 24/20*** | (2011.01) |
| *H01R 24/22* | (2011.01) |

(52) U.S. Cl.

CPC ..... *H01R 4/5008* (2013.01); *H01R 4/4818* (2013.01); *H01R 4/4836* (2013.01); *H01R 24/20* (2013.01); *H01R 24/22* (2013.01)

(58) Field of Classification Search

CPC ..... H01R 4/48
USPC ..... 439/682, 441, 828, 535, 829
See application file for complete search history.

(56) References Cited

U.S. PATENT DOCUMENTS

| | | | | |
|---|---|---|---|---|
| 2,466,930 | A | 4/1949 | Cook | |
| 2,720,634 | A | 10/1955 | Hart | |
| 3,093,433 | A | 6/1963 | Ege | |
| 3,945,711 | A | 3/1976 | Hohorst | |
| 3,963,305 | A | 6/1976 | Doktor | |
| 4,563,054 | A | 1/1986 | Wilmes | |
| 5,454,730 | A | 10/1995 | Tozuka | |
| 5,494,456 | A | 2/1996 | Kozel | |
| 5,679,021 | A | 10/1997 | Kramer | |
| 5,735,700 | A | 4/1998 | Hohorst | |
| 5,816,867 | A | 10/1998 | Davidsz | |
| 5,975,940 | A | 11/1999 | Hartmann | |
| 6,132,238 | A | 10/2000 | Hartmann | |
| 6,146,187 | A | 11/2000 | Pallai | |
| 6,146,217 | A | 11/2000 | Osada | |
| 6,155,890 | A | 12/2000 | Gerberding | |
| 6,464,545 | B2 * | 10/2002 | Yano | 439/828 |
| 6,634,898 | B2 | 10/2003 | Clements | |
| 6,682,364 | B2 | 1/2004 | Cisey | |
| 6,719,581 | B2 | 4/2004 | Kikuchi | |
| 6,746,286 | B2 | 6/2004 | Blaha | |
| 6,814,608 | B2 | 11/2004 | Kollmann | |

(Continued)

*Primary Examiner* — Abdullah Riyami
*Assistant Examiner* — Nelson R Burgos-Guntin
(74) *Attorney, Agent, or Firm* — Roylance, Abrams, Berdo & Goodman, L.L.P.

(57) ABSTRACT

An electrical connector includes a housing and a conductive contact assembly disposed in the housing. A first contact member of the contact assembly receives a blade contact of an electrical device. A second contact member receives an electrical wire through a push-in connection. The electrical connector is receivable by an aperture in a rear surface of the electrical device.

12 Claims, 13 Drawing Sheets

(56) References Cited

U.S. PATENT DOCUMENTS

| | | | | |
|---|---|---|---|---|
| 6,832,938 | B2 | 12/2004 | Lenker | |
| 6,911,602 | B2 | 6/2005 | Conrad | |
| 6,981,890 | B2 | 1/2006 | Cutler | |
| 7,083,463 | B2 | 8/2006 | Steinkemper | |
| 7,115,001 | B1 | 10/2006 | Brockman | |
| 7,131,857 | B2 | 11/2006 | Mueller | |
| 7,140,887 | B2 | 11/2006 | Poh | |
| 7,179,137 | B1 * | 2/2007 | Quendt et al. | 439/828 |
| 7,238,043 | B2 | 7/2007 | Reibke | |
| 7,241,188 | B2 | 7/2007 | Lin | |
| 7,249,963 | B2 | 7/2007 | Ramm | |
| 7,281,942 | B2 | 10/2007 | Swedberg | |
| 7,384,319 | B2 | 6/2008 | Kirstein | |
| 7,402,075 | B1 | 7/2008 | Probst | |
| 7,438,587 | B2 | 10/2008 | Germani | |
| 7,527,509 | B1 | 5/2009 | Bethurum | |
| 7,628,640 | B2 | 12/2009 | Radle | |
| 7,645,158 | B2 | 1/2010 | Mulhouse | |
| 7,651,363 | B2 | 1/2010 | Koellmann | |
| 7,690,952 | B2 | 4/2010 | Koellmann | |
| 7,749,018 | B1 | 7/2010 | Benoit et al. | |
| 7,794,268 | B2 | 9/2010 | Breen, IV | |
| 7,815,463 | B2 | 10/2010 | Gerberding | |
| 7,845,970 | B2 | 12/2010 | Stromiedel | |
| 7,896,686 | B2 | 3/2011 | Hoppe | |
| 7,963,812 | B2 | 6/2011 | Ilkhanov | |
| 7,976,330 | B2 | 7/2011 | Lin | |
| 8,096,818 | B2 | 1/2012 | Arenas | |
| 8,235,748 | B2 | 8/2012 | Lacey | |
| 8,466,367 | B2 * | 6/2013 | Reibke | 174/135 |

* cited by examiner

PUSH WIRE CONNECTOR HAVING A SPRING BIASING MEMBER

CROSS REFERENCE TO RELATED APPLICATION

This application claims the benefit under 35 U.S.C. §119 (e) of U.S. Provisional Application Ser. No. 61/697,106, filed Sep. 5, 2012, which is hereby incorporated by reference in its entirety. This application contains subject matter related to co-pending U.S. patent application Ser. No. 14/015,404, entitled "Push Wire Connector Having A Rotatable Release Member," filed Aug. 30, 2013, which is hereby incorporated by reference in its entirety.

FIELD OF THE INVENTION

The present invention relates generally to push wire connectors for terminating electrical wires. More particularly, the present invention relates generally to push wire connectors for terminating electrical wires having a spring biasing member to facilitate electrically and mechanically engaging inserted electrical wires. Still more particularly, the present invention relates to a push wire electrical connector having push wire connections for terminating a plurality of electrical wires and connectable to an electrical device to provide electrical continuity between the electrical wires and the electrical device.

BACKGROUND OF THE INVENTION

Some electrical devices have apertures in their rear faces for receiving a plug terminating a plurality of wires, as disclosed in U.S. Pat. No. 4,842,551 to Heimann. The wires terminated by the plug are connected to the existing building wires in any suitable manner, such as by a clamp receptacle or a twist-on wire connector. However, connecting each plug wire to a building wire with the twist-on wire connector, or similar device, requires time to make the connection. Additionally, a significant amount of wire needs to be inserted in the electrical box when connecting the electrical receptacle to an electrical box. The large amount of wire can be difficult to dispose in the electrical box with the electrical device. Accordingly, a need exists for a plug that snaps into an aperture in a rear surface of the electrical device and terminates existing building wires through a push wire connection.

SUMMARY OF THE INVENTION

An object of the present invention is to provide a push wire connector for securely, quickly and easily terminating electrical wires.

Another object of the present invention is to provide a push wire connector having a spring biasing member to facilitate electrically and mechanically engaging inserted electrical wires.

Another object of the present invention is to provide an electrical connector for terminating a plurality of electrical wires and being connectable to an electrical device to provide electrical continuity between the electrical wires and the electrical device.

The foregoing objectives are basically attained by an electrical connector including a housing and a conductive contact assembly disposed in the housing. A first contact member of the contact assembly receives a blade contact of an electrical device. A second contact member receives an electrical wire through a push-in connection. The electrical connector is receivable by an aperture in a rear surface of the electrical device.

The foregoing objectives are also basically attained by an electrical connector having a housing and a conductive contact member disposed in the housing. A first end of the contact member receives a blade contact of an electrical device and a second end electrically engages an electrical wire. A spring member disposed in the housing is connected to the contact member. The spring member has a first opening through which a wire is passed to electrically engage the contact member. The spring member biases the inserted wire against the second end of the contact member.

The foregoing objectives are also basically attained by an electrical device having an aperture in a rear surface thereof and a plurality of contact blades disposed in the aperture. An electrical connector is receivable in the aperture. The electrical connector includes a housing having at least one first opening therein for receiving a wire. A conductive contact member is disposed in the housing adjacent the at least one first opening and has a first contact portion for receiving one of the plurality of contact blades of the electrical device and a second contact portion. A spring member is disposed in the housing and connected to the contact member. The spring member has a second opening aligned with the first opening through which a wire is passed to electrically engage the contact member biasing the inserted wire against the second contact portion of the contact member.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENTS

Figure 1:
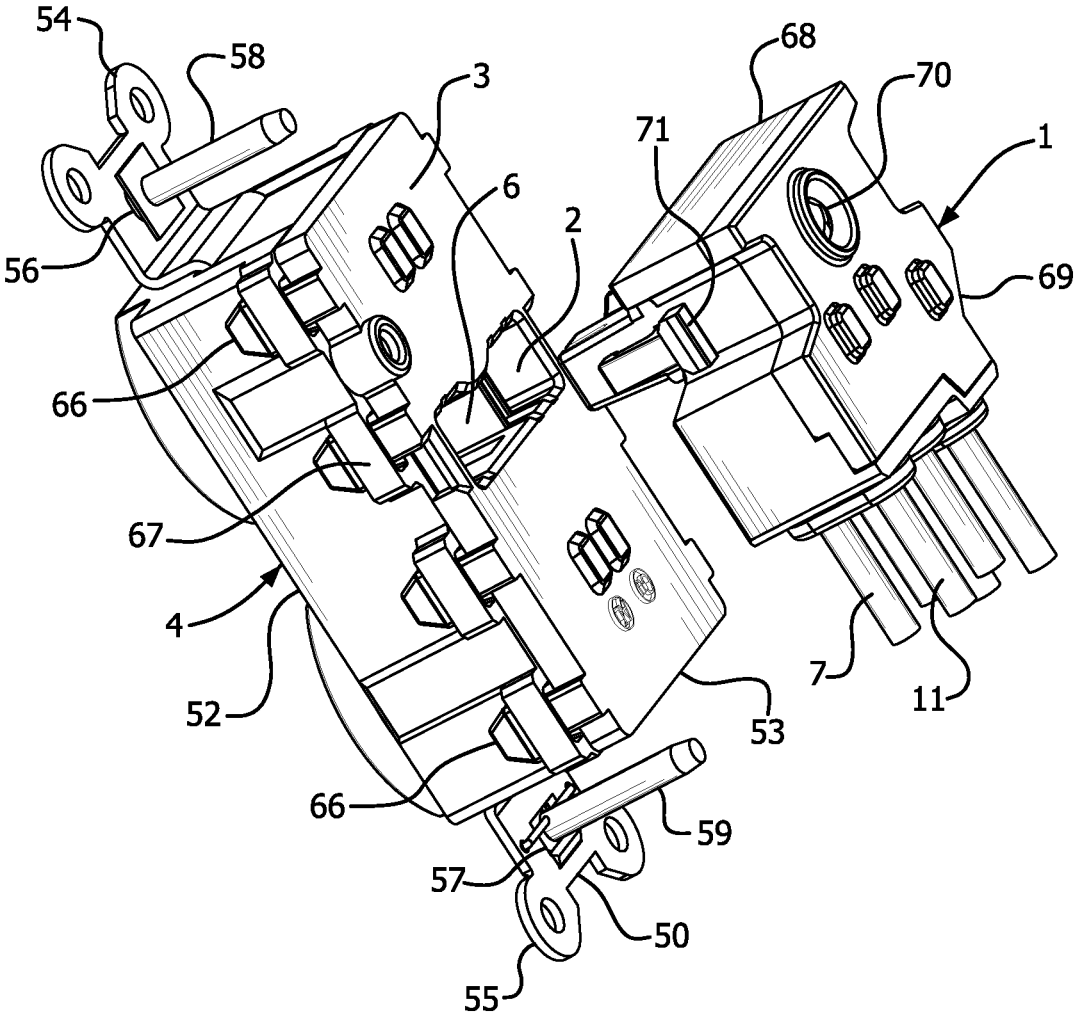
FIG. 1 is an exploded perspective view of an electrical wiring device with a push wire connector in accordance with a first exemplary embodiment of the present invention prior to connecting to the electrical wiring device.

The exemplary embodiments of the present invention are directed to an electrical connector that terminates electrical wires through a push wire connection, as shown in FIGS. 1-33.

An electrical connector 1 in accordance with a first exemplary embodiment of the present invention does not require a tool for electrical wire termination, as shown in FIGS. 1-20. The electrical connector 1 is received in an aperture 2 in a rear surface 3 of an electrical device 4, such as an electrical receptacle. The electrical connector 1 has a plurality of contact assemblies 5 that engage blades 6 disposed in the aperture 2 of the electrical receptacle 4, thereby establishing electrical continuity between the building wires 7 and the electrical receptacle 4. Although the electrical connector in accordance with exemplary embodiments of the present invention is described with respect to the electrical receptacle 4, the present invention is not so limited and any suitable electrical device may be used.

Figure 2:
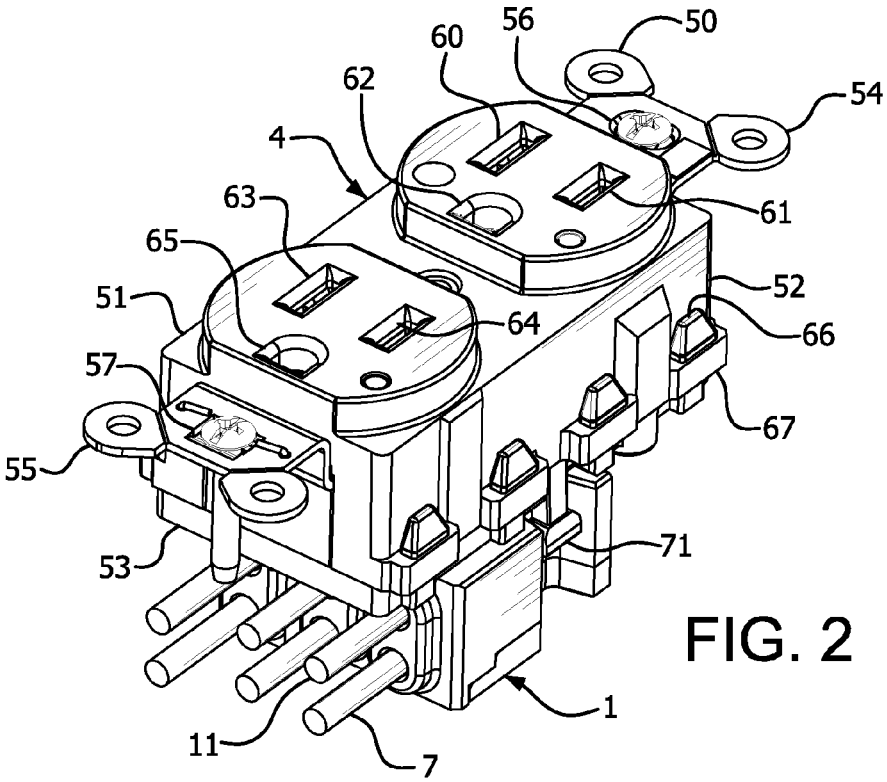
FIG. 2 is a front perspective view of the push wire connector of FIG. 1 connected to the electrical wiring device.
Figure 3:
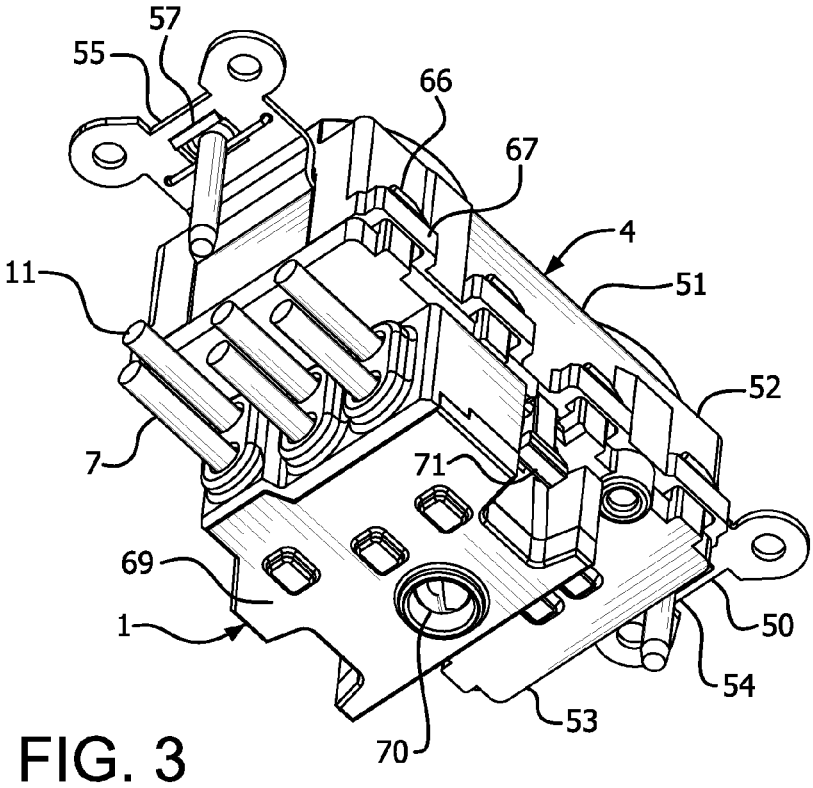
FIG. 3 is a rear perspective view of the push wire connector connected to the electrical wiring device of FIG. 2.
Figure 4:
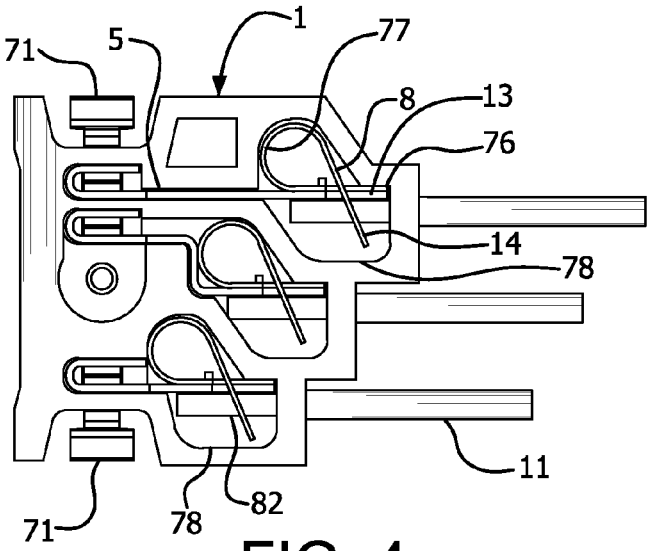
FIG. 4 is a rear plan view of the push wire connector of FIG. 1 with a cover of the housing removed.

The electrical device 4 includes a housing 51 having the rear surface 3 and the aperture 2 disposed in the rear surface. A ground or mounting strap 50 is connected to the housing 51 and is adapted to secure the electrical device 4 to an electrical box (not shown). A plurality of contact blades 6 are disposed in the electrical device 4 and are accessible through the aperture 2 (FIG. 4). The electrical connector 1 includes a plurality of contact assemblies 5 adapted to engage the plurality of contact blades 6 in the electrical device 4, as shown in FIGS. 2 and 3. The wires 7 terminated by the electrical connector 1 extend outwardly therefrom such that the plurality of wires are substantially parallel to the rear surface 3 of the electrical device 4 when the electrical connector 1 is connected to the electrical device 4. Alternatively, the wires 7 can be terminated such that the wires are substantially perpendicular to the rear surface 3 of the electrical receptacle 4.

The electrical device 4 includes a cover 52 connected to a base 53, as shown in FIGS. 1-3. The mounting strap 50 is connected to the electrical device 4 to facilitate mounting the electrical device to the electrical box (not shown). First and second mounting ears 54 and 55 are disposed at opposite ends of the ground strap 50. Each mounting ear 54 and 55 has an opening 56 and 57 to receive a fastener 58 and 59 to secure the electrical device 4 to the electrical box in a conventional manner. The ground strap 50 may be disposed between the cover 52 and the base 53, or may wrap around the rear surface 3 of the base 53.

A first plurality of openings 60, 61 and 62 are formed in the cover 52 to receive a first plug (not shown) of an electrical apparatus to be powered by the electrical device 4. A second plurality of openings 63, 64 and 65 are formed in the cover 52 to receive a second plug (not shown) of an electrical apparatus to be powered by the electrical device 4. The cover 52 has a plurality of downwardly extending posts 66 that are receivable by pockets 67 of the base 53, thereby creating a snap fit to secure the cover 52 to the base 53 as shown in FIGS. 1-3.

The aperture 2 disposed in the rear surface 3 of the base 53, as shown in FIG. 1, is adapted to receive the electrical connector 1 that terminates building wires 7 that supply electrical power. Preferably, three contact blades 6 are disposed in the aperture 2, although any suitable number of contact blades may be used. For example, a three contact blade configuration has outer contact blades that are power blades, hot and neutral contact blades, and a middle contact blade that is a ground contact blade.

The electrical connector 1 has three building wires 7 connected thereto, as shown in FIGS. 1-3. Although the electrical connector 1 of the first exemplary embodiment of the present invention is shown having three building wires 7 connected thereto, any suitable number of building wires may be used as required by the electrical apparatus for use with the electrical device 4. The building wires 7 are connected to the electrical connector 1 as described below. A plurality of feed-through wires 11 can be connected to the electrical connector 1, as shown in FIGS. 1-3, to supply power to another electrical device, such as an another electrical connector.

Figure 6:
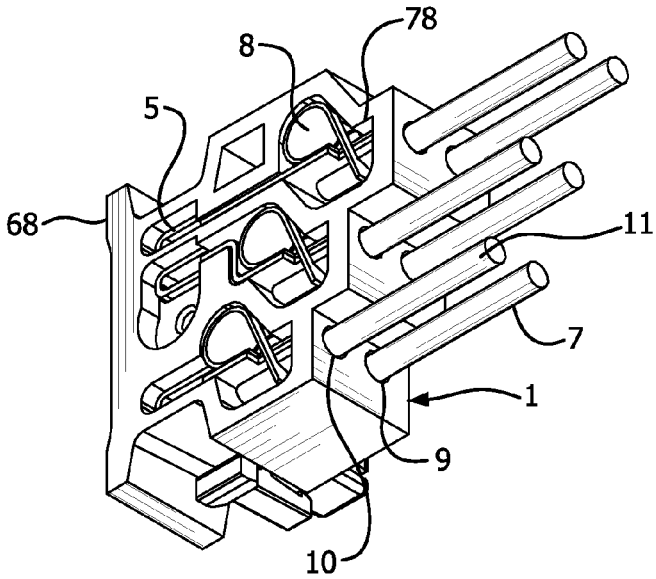
FIG. 6 is a rear perspective view of the push wire connector of FIG. 4.
Figure 7:
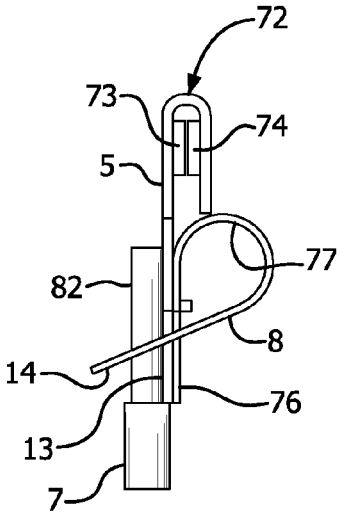
FIG. 7 is a rear plan view of the contact member and spring member of the push wire connector of FIG. 4 receiving an electrical wire.

The electrical connector 1 is received by the aperture 2 in the base 53 of the electrical device 4, as shown in FIGS. 2 and 3. A plurality of openings are disposed in a front face of the electrical connector 1 to receive the contact blades 6. The electrical connector 1 has a base 68 and a cover 69 connected thereto. A fastener 70 connects the cover 69 to the base 68. A plurality of openings 9 and 10 are formed in the base 68 of the electrical connector 1 to receive the wires 7 and 11, respectively. The openings 9 and 10 are preferably disposed on the same side of the base 68, as shown in FIGS. 4 and 6.

Latching arms 71 are disposed on opposite sides of the base 68 of the electrical connector 1, as shown in FIGS. 1-3. The latching arms 71 are flexible to facilitate connecting the electrical connector to and disengaging from the electrical device 4. The latching arms 71 are deflectable to disengage the electrical connector 1 from a mated connection with the electrical device 4.

Each of the wires 7 is terminated by a contact assembly 72, as shown in FIGS. 4-20. The contact assembly 72 includes the contact member 5 and the spring member 8. The contact member 5 receives the contact blade 6 of the electrical device 4 and the spring member 8 terminates the building wire 7.

Figure 8:
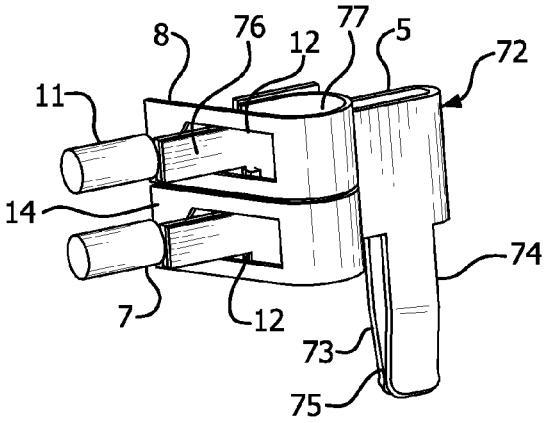
FIG. 8 is a front perspective view of the contact member and spring member of the push wire connector of FIG. 4.
Figure 9:
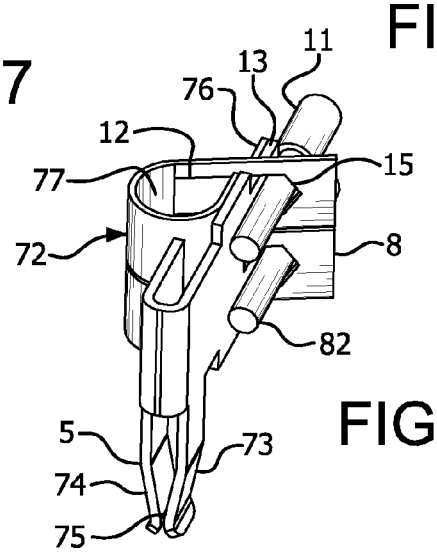
FIG. 9 is a rear perspective view of the contact member and spring member of the push wire connector of FIG. 4.
Figure 10:
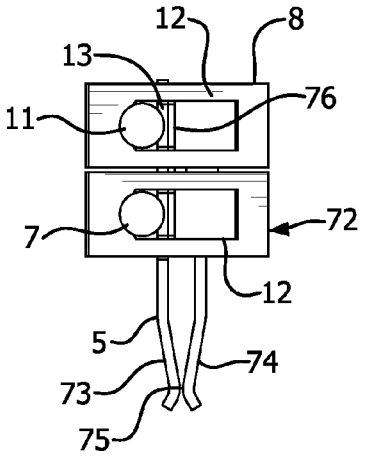
FIG. 10 is a side elevational view of the contact member and spring member of the push wire connector of FIG. 4.
Figure 11:
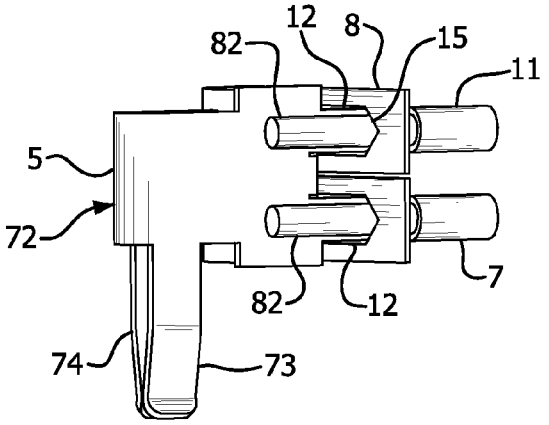
FIG. 11 is a side perspective view of the contact member and spring member of the push wire connector of FIG. 4.
Figure 12:
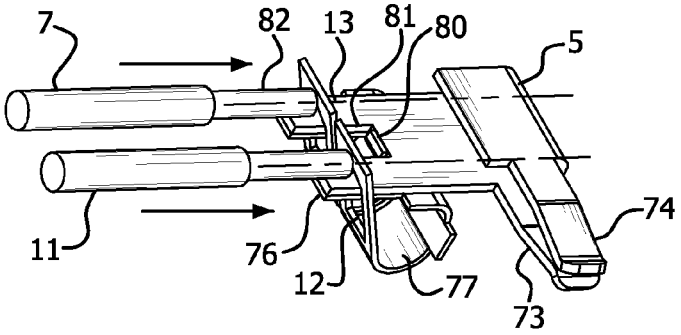
FIG. 12 is a perspective view of the contact and spring members of FIG. 7 prior to terminating electrical wires.
Figure 13:
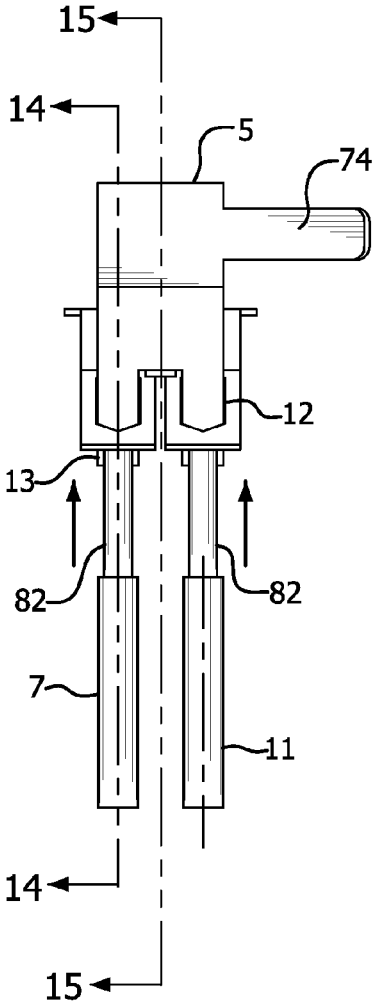
FIG. 13 is a top plan view of the contact and spring members of FIG. 12.
Figure 14:
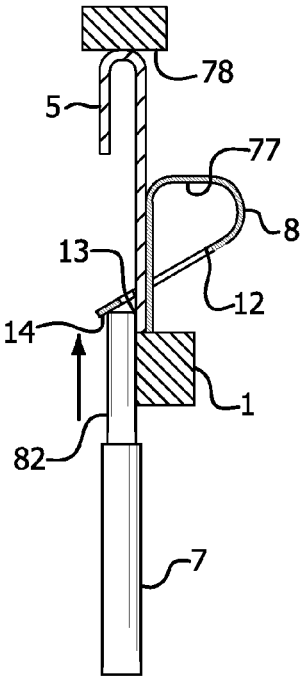
FIG. 14 is a side elevational view in cross section of the contact and spring members taken along line 14-14 of FIG. 13.

The contact member 5 of the contact assembly 72 has first and second flexible fingers 73 and 74, as shown in FIGS. 8-11, to engage one of the contact blades 6 of the electrical device 4. The flexible fingers 73 and 74 of the contact member 5 contact each other to form a gripping potion 75, as shown in FIGS. 8, 9 and 11 therebetween to receive a contact blade 6. A gap is formed between outwardly extending portions at the free ends of the flexible fingers 73 and 74 of the contact member 5 to facilitate receiving the contact blade 6 therebetween.

Figure 5:
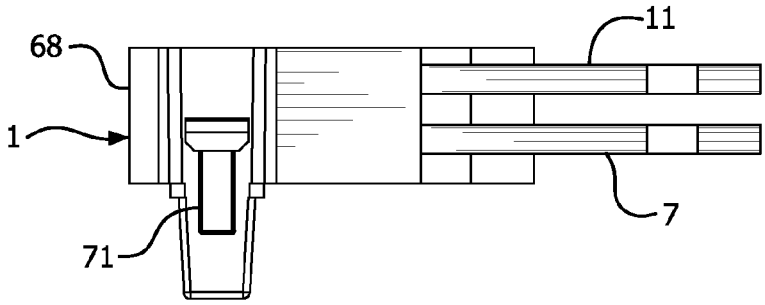
FIG. 5 is a side elevational view of the push wire connector of FIG. 4.
Figure 15:
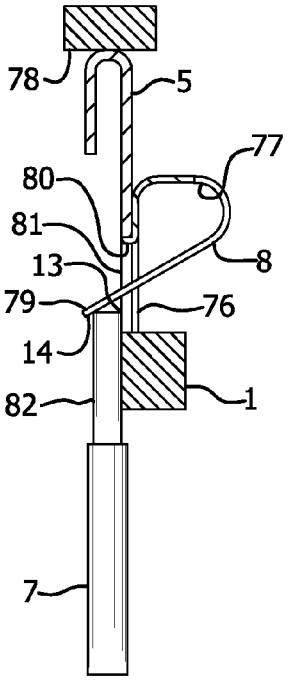
FIG. 15 is a side elevational view in cross section of the contact and spring members taken along line 15-15 of FIG. 13.
Figure 16:
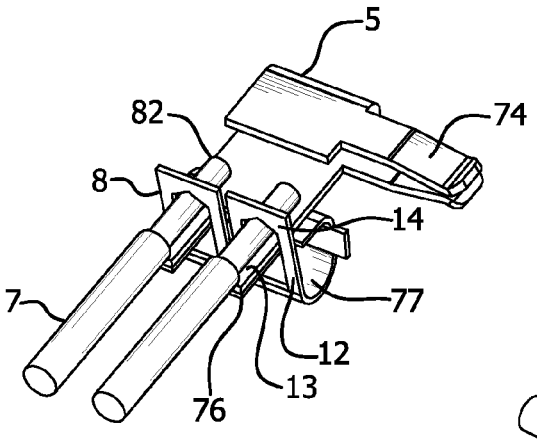
FIG. 16 is a front perspective view of the contact and spring members of FIG. 12 after terminating electrical wires.
Figure 17:
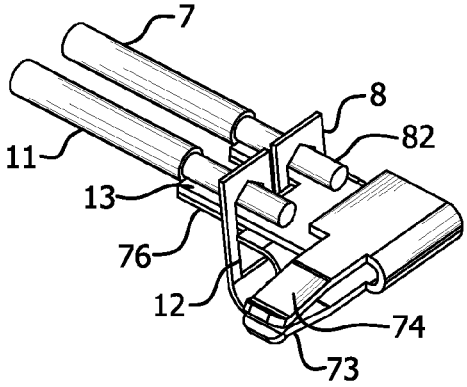
FIG. 17 is a rear perspective view of the contact and spring members of FIG. 16 after terminating electrical wires.

The spring member 8 has an opening 12 through which the inserted wire passes. The opening 12 is formed in a surface 14 of the spring member 8 engaged by the wire when it is inserted in the electrical connector 1. A first end 76 of the spring member 8 is substantially planar and contacts the contact member 5, as shown in FIG. 4. A second end 79 of the spring member 8 is substantially planar and passes through the opening 12 in the spring member 8, as shown in FIG. 5. An enclosed portion 77 of the spring member 8 is formed between the first and second ends 76 and 79. The opening 12 is disposed in the first end 76 of the spring member 8. A tab 80 extends downwardly from the first end 76 and is received by a recess 81 in the contact member 5 to align and connect the spring member 8 to the contact member 5, as shown in FIG. 15.

The spring member 8 and the contact member 5 are disposed in a cavity 78 in the base 68 of the electrical connector 1, as shown in FIGS. 4-6. The spring member 8 and the contact member 5 are secured together by spring pressure. The wire openings 9 and 10 in the base 68 of the electrical connector 1 provide access to the cavities 78.

Figure 18:
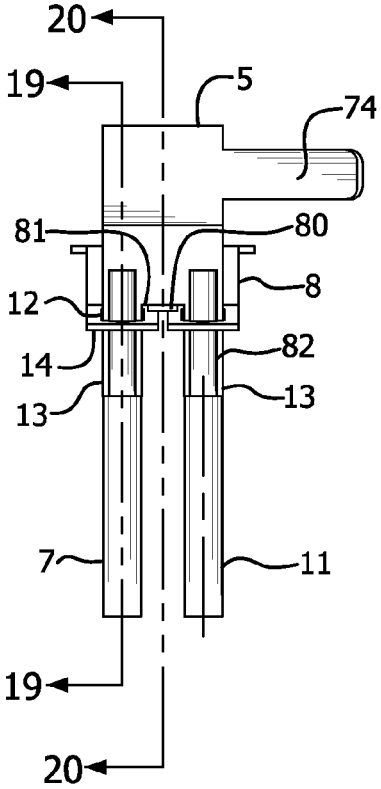
FIG. 18 is a top plan view of the contact and spring members of FIG. 16.
Figure 19:
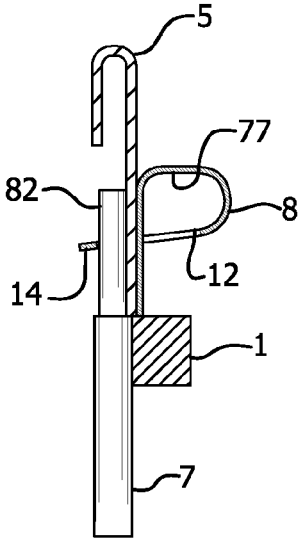
FIG. 19 is a side elevational view in cross section of the contact and spring members taken along line 19-19 of FIG. 18.
Figure 20:
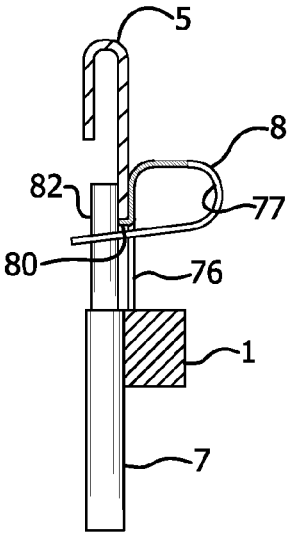
FIG. 20 is a side elevational view in cross section of the contact and spring members taken along line 20-20 of FIG. 18.

As shown in FIGS. 8-13 and 16-18, each contact assembly 72 preferably has two openings 12 disposed in the second end 79 of the spring member 8, thereby facilitating connecting building wire 7 and feed-through wire 11 to each contact assembly 72 to provide electrical continuity therebetween. Two portions of the wire contacting portion 13 of the contact member 5 pass through the openings 12 to receive the inserted wires. The recess 81 is disposed between the two portions of the wire contacting portion 13, as shown in FIG. 18, to facilitate receiving the tab 80 of the spring member 8.

The electrical connector 1 uses the spring members 8 to terminate the existing building wires 7 within the connector 1. An installer inserts the building wires 7 directly into the connector 1 without requiring the use of a tool. The spring members 7 are preferably non-releasable such that the wires must be cut to separate the wires from the electrical connector 1. Preferably, the electrical connector 1 has three contact members 5 corresponding to the hot, neutral and ground building wires 7. Each contact member 5 has a separate spring member 8 and two entry holes 9 and 10 per contact member, such that six total wires can be terminated. The first hole 9 of each set of entry holes is for receiving the existing building wires 7. The second hole 10 of each set of entry holes is for receiving wires 11 for feed-through. Preferably, as shown in FIG. 6, all the entry holes 9 and 10 are formed on the same side of the electrical connector 1.

Preferably, the spring members 8 do not act as insulation displacement contacts, such that the wires must be stripped prior to insertion. Inserting the stripped portion 82 of the wire 7 through the hole 9 opens the spring member 8, thereby eliminating the need for a tool to open the spring member. The inserted wire 7 then becomes clamped between the spring member 8 and the contact member 5, as shown in FIGS. 7-11. Preferably, no means are provided to defeat the spring members 8, such that inserted wires cannot be removed. The wires must be cut to remove the electrical connector 1 from the inserted wires.

The inserted wire pushes against the surface 14 of the second end 79 of the spring member 8 until the wire passes through the opening 12, as shown in FIGS. 12-20. A portion 13 of the contact member 5 passes through the spring member opening 12 and is engaged by the stripped portion 82 of the inserted wire. The first end 76 of the spring member contacts the wire contacting portion 13 of the contact member 5. The spring force of the spring member 8 clamps the inserted wire between an upper edge 15 of the opening 12 of the spring member 8 and the contact member 5.

After the wires have been inserted, the electrical connector can be inserted in the aperture 2 in the rear surface 3 of the electrical wiring device 4, as shown in FIGS. 1-3. The wires can be quickly and easily inserted in the wire entry holes 9 and 10 in the electrical connector 1 without requiring the use of tools. The electrical connecter 1 can be quickly and easily connected to the electrical wiring device 4 without requiring the use of tools. Accordingly, electrical continuity can be established between the existing building wires and the electrical wiring device quickly and easily without requiring the use of tools.

The spring member 8 is preferably made of a resilient metal, such as spring steel. The contact member 5 is preferably made of a conductive material, such as brass.

Figure 21:
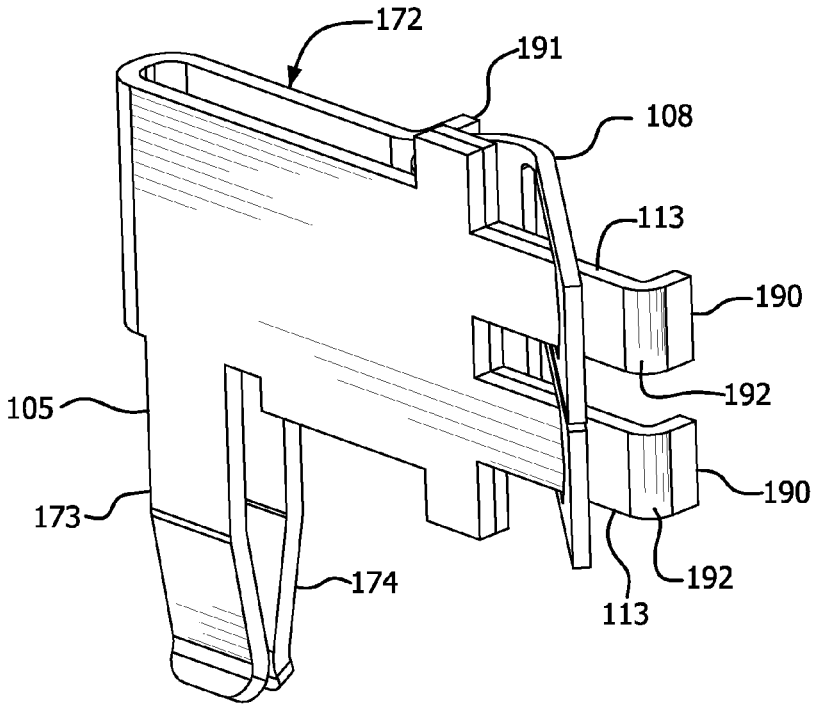
FIG. 21 is an upper perspective view of a contact member and a spring member in accordance with a second exemplary embodiment of the present invention.
Figure 22:
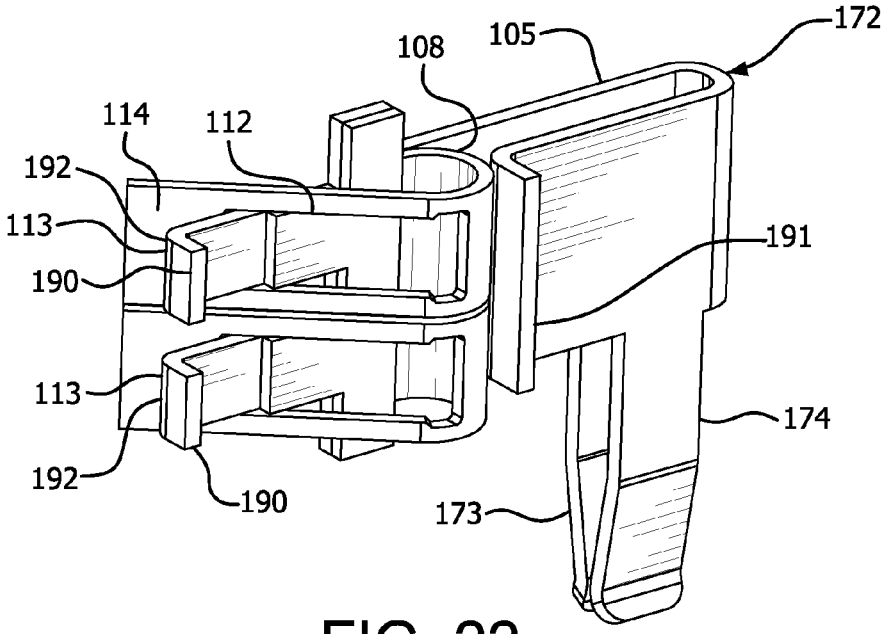
FIG. 22 is a lower perspective view of the contact member and spring member of FIG. 21.
Figure 23:
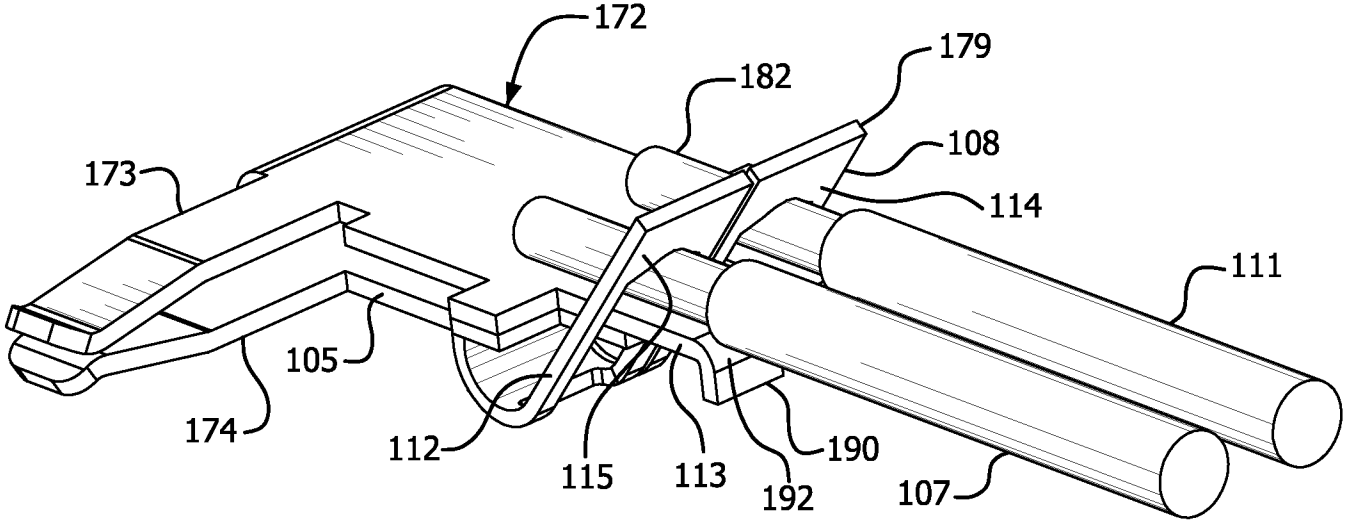
FIG. 23 is a perspective view of the contact member and the spring member of FIG. 21 terminating electrical wires.

A contact assembly 172 in accordance with a second exemplary embodiment of the present invention, as shown in FIGS. 21-23, is substantially similar to the contact assembly 72 of the first exemplary embodiment. The configuration of the contact member 105 and the spring member 108 is substantially similar to that of the contact assembly 72 of the first exemplary embodiment except for the distinctions noted below. Similar features are indicated with the same reference numeral in the 100 series, i.e., 1xx.

First hooks 190 are formed at ends of the wire contacting portions 113 of the contact member 105. Second hooks 191 are formed at opposite ends of the contact member 108. The hooks 190 and 191 anchor the contact member 105 in the cavity (78 of FIG. 4), thereby substantially preventing shifting or movement of the contact assembly 172 during wire insertion. Referring to FIG. 4, the hooks 190 and 191 contact opposite walls defining the cavity. Additionally, a radius forms a rounded surface 192 at the first hook 190 to facilitate wire insertion. The rounded surface 192 of the first hook 190 provides a lead-in for the wire inserted in the opening 112 in the spring member 108.

Figure 24:
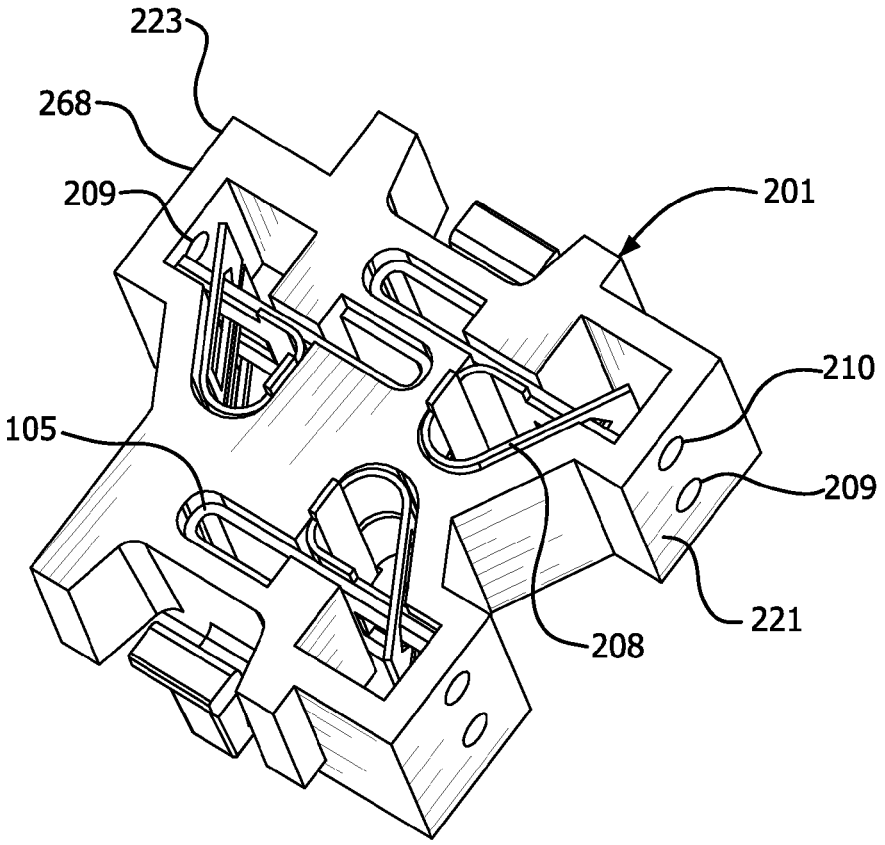
FIG. 24 is a perspective view in section of a push wire connector in accordance with a third exemplary embodiment of the present invention.
Figure 25:
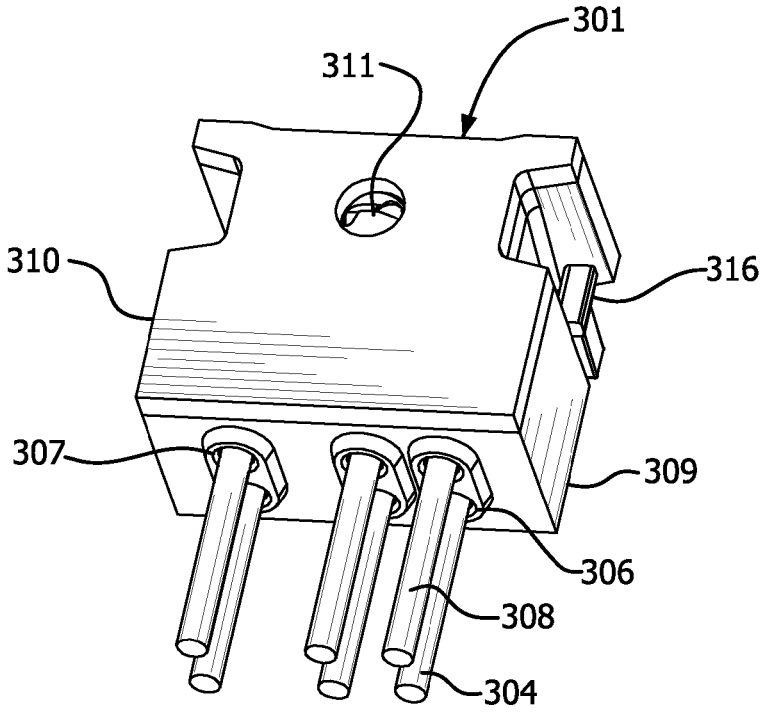
FIG. 25 is a rear perspective view of a push wire connector in accordance with a fourth exemplary embodiment of the present invention.
Figure 26:
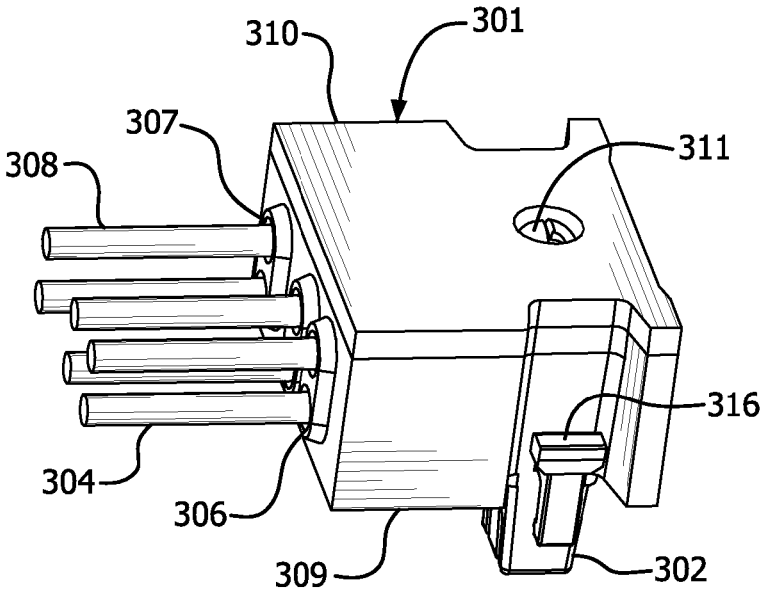
FIG. 26 is a side perspective view of the push wire connector of FIG. 25.
Figure 27:
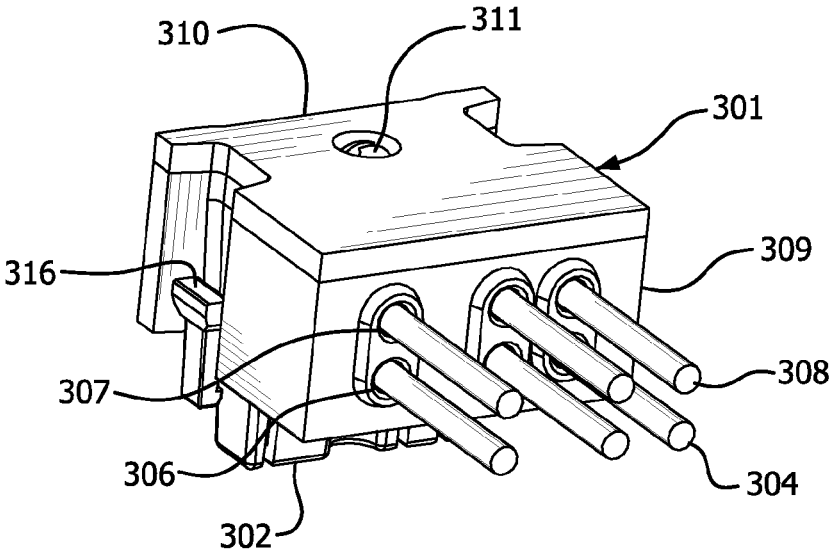
FIG. 27 is a left rear perspective view of the push wire connector of FIG. 25.
Figure 28:
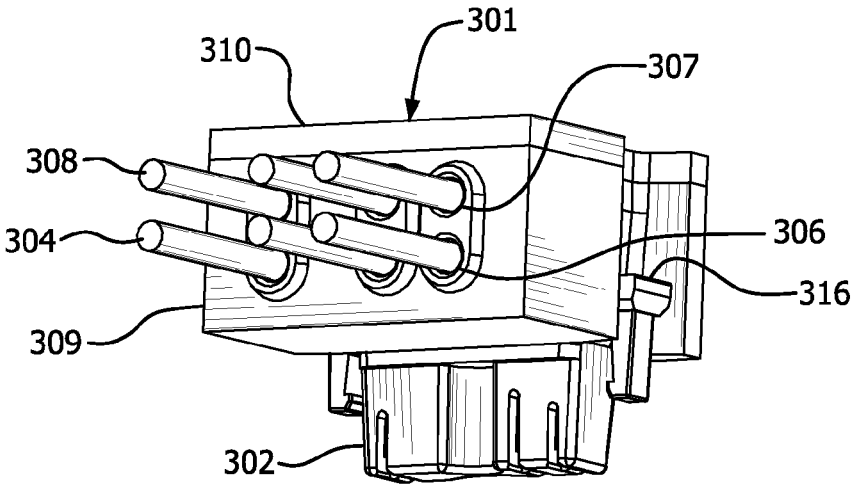
FIG. 28 is a right rear perspective view of the push wire connector of FIG. 25 showing the plug connector.

An electrical connector 201 in accordance with a third exemplary embodiment of the present invention, as shown in FIG. 24, is substantially similar to the electrical connector 1 of the first exemplary embodiment. The electrical connector 201 disposes two sets of entry holes 209 and 210 on a first side 221 of a base 268, and a second set of entry holes on a second side 223 of the base 268, as shown in FIG. 24. The configuration of the contact member 205 and the spring member 208 is substantially similar to the electrical connector 1 of the first exemplary embodiment. Similar features are indicated with the same reference numeral in the 100 series, i.e., 1xx. The contact member 205 can include the hooks of the second exemplary embodiment.

An electrical connector 301 in accordance with a fourth exemplary embodiment of the present invention is shown in FIGS. 25-33. The electrical connector 301 is substantially similar to the electrical connector 1 of the first exemplary embodiment with the exception of the distinctions noted below.

The electrical connector 301 includes a plug connector 302 adapted to be received in an aperture in a rear surface of an electrical wiring device 4 (FIGS. 1-3). The electrical connector 301 has a plurality of contact members 303 that engage blades disposed in the aperture of the electrical receptacle, thereby establishing electrical continuity between building wires 304 and the electrical wiring device 4.

Figure 29:
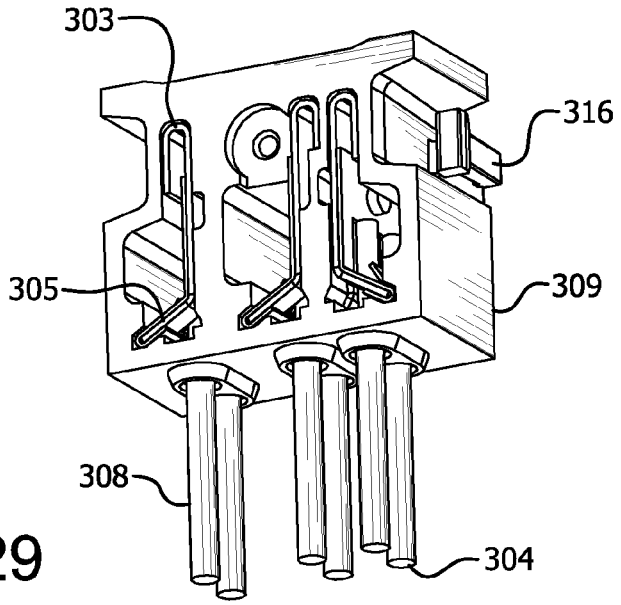
FIG. 29 is a rear perspective view of the push wire connector of FIG. 25 with the cover removed.
Figure 30:
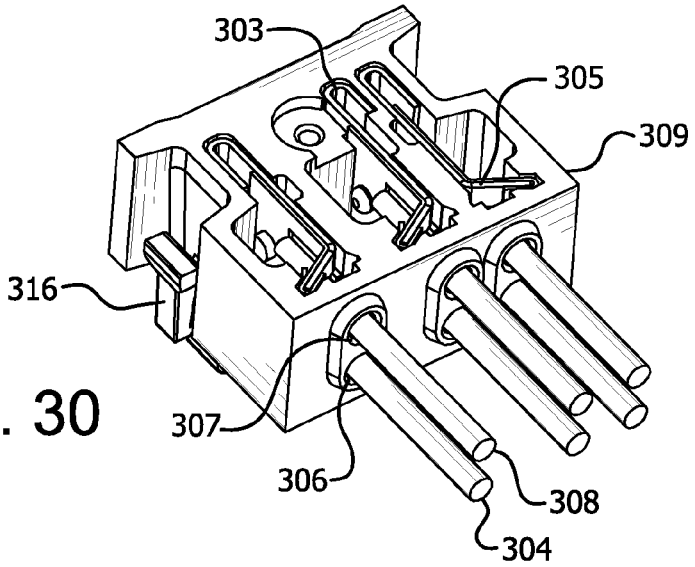
FIG. 30 is a rear perspective view of the push wire connector of FIG. 29.
Figure 31:
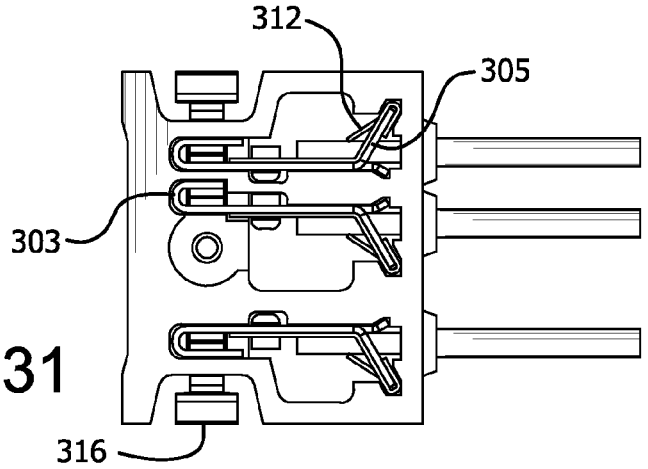
FIG. 31 is a bottom plan view of the push wire connector of FIG. 29.

The electrical connector 301 includes spring members 305 to terminate the existing building wires 304 within the electrical connector 301, as shown in FIGS. 29-31. An installer inserts the building wires 304 directly into the connector 301 without requiring the use of a tool. A contact assembly 331 disposed in the electrical connector 301 provides electrical continuity between existing building wires 304 and an electrical wiring device when the electrical connector is connected to the electrical wiring device (FIGS. 1-3).

The contact assembly 331 includes a contact member 303 and a spring member 305. The contact and spring members 303 and 305 can be connected in any suitable manner, such as with a rivet 332.

The spring members 305 are preferably non-releasable such that the wires must be cut to separate the wires from the electrical connector 301. Preferably, the electrical connector 301 has three contact members 303 corresponding to the hot, neutral and ground building wires 304, as shown in FIGS. 29-31. Each contact member 303 has a separate spring member 305 and two entry holes 306 and 307 per contact member, such that six total wires can be terminated. The first hole 306 of each set of entry holes is for receiving the existing building wires 304. The second hole 307 of each set of entry holes is for receiving wires 308 for feed-through. Preferably, as shown in FIGS. 29 and 30, all the entry holes 306 and 307 are formed on the same side of the electrical connector 301.

The contact members 303 and the spring members 305 are disposed in a housing formed by a housing base 309 and a cover 310. The cover 310 is secured to the base 309 with a fastener 311, although any suitable means of connection can be used. Snap arms 316 connected to the base 309 facilitate securing the connector 301 to the electrical wiring device 4 (FIG. 1).

Figure 32:
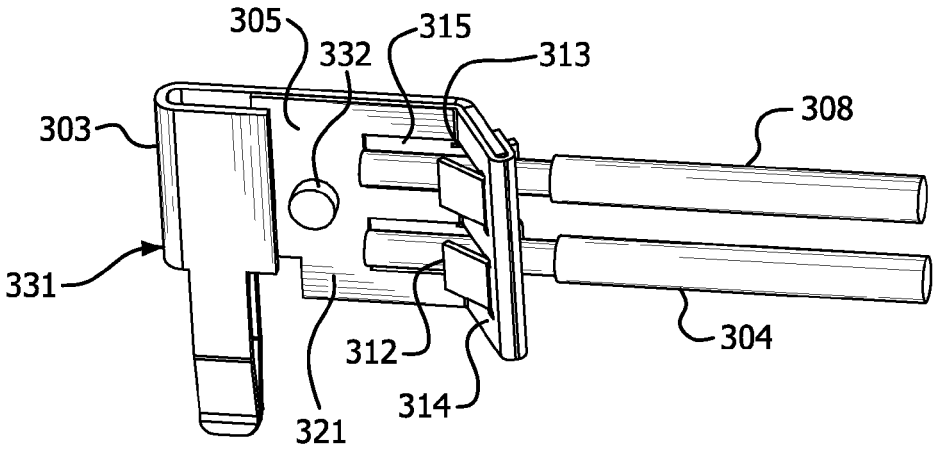
FIG. 32 is a perspective view of the spring member and the contact member of the push wire connector of FIG. 29.
Figure 33:
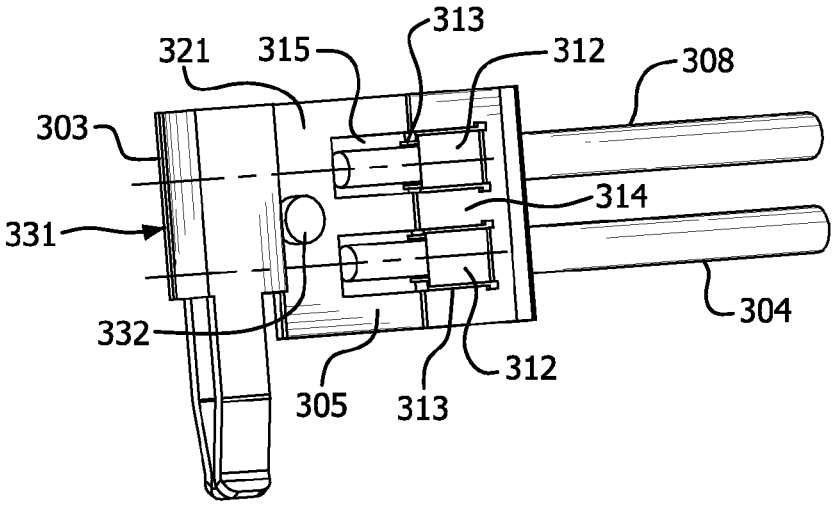
FIG. 33 is a perspective view of the spring member and the contact member of the push wire connector of FIG. 29.

Preferably, the spring members 305 do not act as insulation displacement contacts, such that the wires must be stripped prior to insertion. The spring member 305 includes a resilient tab 312 disposed in the spring member opening 313, as shown in FIGS. 32 and 33. Preferably, the resilient tab 312 is formed when the opening 313 is cut in the spring member 305, such that the resilient tab is unitarily formed as a single piece with the spring member. The opening 313 extends from a first portion 314 to a second portion 321 of the spring member 305. An obtuse angle is preferably formed between the first and second portions 314 and 321 of the spring member 305.

The inserted wire 304 pushes against the spring tab 312 until the wire passes through the opening 313. A portion 315 of the contact member 303 is accessible through the spring member opening 313 disposed in the second portion 321 of the spring member. The wire engaging portion 315 contacts the inserted wire 304, as shown in FIGS. 32 and 32. The spring force of the tab 312 clamps the inserted wire between the tab 312 and the portion 315 of the contact member 303 accessible through the opening 313 in the second portion 321 of the spring member 305.

Inserting the wire 304 through the opening 306 in the electrical connector 301 engages the spring tab 312 disposed in the spring member opening 313 of the spring member 305, thereby eliminating the need for a tool to open the spring member. The inserted wire 304 is clamped between the spring tab 312 and the contact member 303, as shown in FIGS. 29-33. Preferably, no means are provided to defeat the spring members 305, such that inserted wires cannot be removed. The wires must be cut to remove the electrical connector 301 from the inserted wires 304 and 308. Hooks can be formed on the contact member 303, in a similar manner as shown in FIGS. 21-23, to substantially prevent shifting or movement of the contact assembly during wire insertion.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An electrical connector, comprising:

a housing; and a conductive contact assembly disposed in said housing and having a first contact member for receiving a blade contact of an electrical device and a second contact member for receiving an electrical wire through a push-in connection, said electrical connector being receivable by an aperture in a rear surface of the electrical device, said second contact member has a substantially planar portion and a spring with a first opening to receive the electrical wire, said spring being configured to bias the electrical wire against said second contact member, and said spring and said substantially planar portion extending through said first opening in said spring.

2. The electrical connector according to claim 1, wherein said first contact member has a contact portion disposed adjacent said first opening in said spring member.

3. The electrical connector according to claim 1, wherein said spring member has a pair of first openings for receiving a pair of inserted wires.

4. An electrical connector, comprising:

a housing;

a conductive contact member disposed in said housing and having a first contact portion for receiving a blade contact of an electrical device and a second contact portion for electrically engaging an inserted electrical wire; and a spring member disposed in said housing and connected to said contact member, said spring member having a first opening through which the wire is inserted to electrically engage said contact member, said spring member biasing the inserted wire against said second contact portion of said contact member, wherein an end of said second portion of said contact member has a substantially planar portion extending through said first opening in said spring member.

5. The electrical connector according to claim 4, wherein a contact portion of said spring member in which said first opening is disposed is angularly disposed with respect to said contact member to substantially prevent withdrawal of the inserted wire.

6. The electrical connector according to claim 4, wherein said spring member has a pair of first openings for receiving a pair of inserted wires.

7. The electrical connector according to claim 4, wherein said contact member has a hook engaging an inner surface of said housing to substantially prevent movement of said contact member when the wire is inserted.

8. An electrical device assembly, comprising:

an electrical device having an aperture in a rear surface thereof and a plurality of contact blades disposed in said aperture; and an electrical connector receivable in said aperture, said electrical connector including a housing having at least one first opening therein for receiving a wire;

a conductive contact member disposed in said housing adjacent said at least one first opening and having a first contact portion for receiving one of said plurality of contact blades of said electrical device and a second contact portion; and a spring member disposed in said housing and connected to said contact member, said spring member having a second opening aligned with said first opening through which a wire is passed to electrically engage said contact member biasing the inserted wire against said second contact portion of said contact member, wherein said second contact portion of said contact member has a substantially planar portion extending through said second opening in said spring member.

9. The electrical device assembly according to claim 8, wherein a first longitudinal axis of a first end of said contact member is substantially perpendicular to a second longitudinal axis of a second end of said contact member.

10. The electrical device assembly according to claim 8, wherein pressure exerted by said spring member secures said spring member to said contact member.

11. The electrical device assembly according to claim 8, wherein a resilient tab is disposed in said opening to bias the inserted wire against said second contact portion of said first contact member.

12. The electrical device assembly according to claim 8, wherein said contact member has a hook engaging an inner surface of said housing to substantially prevent movement of said contact member when the wire is inserted.

* * * * *